US005325608A

United States Patent [19]

Mayer

[11] Patent Number: 5,325,608

[45] Date of Patent: Jul. 5, 1994

[54] ARRANGEMENT FOR THE TRANSFER OF A TRAVELING WEB

[75] Inventor: Wolfgang Mayer, Heidenheim, Fed. Rep. of Germany

[73] Assignee: J.M. Voith GmbH, Fed. Rep. of Germany

[21] Appl. No.: 929,973

[22] Filed: Aug. 14, 1992

[30] Foreign Application Priority Data

Aug. 16, 1991 [DE] Fed. Rep. of Germany ..... 9110134

[51] Int. Cl.[5] ..... F26B 11/02

[52] U.S. Cl. ..... 34/114; 34/117; 34/120

[58] Field of Search ..... 34/114, 115, 116, 117, 34/120, 23

[56] References Cited

U.S. PATENT DOCUMENTS

| | | | |
|---|---|---|---|
| 3,250,019 | 9/1962 | Beachler | 34/117 |
| 3,868,780 | 3/1975 | Soininen et al. | 34/116 |
| 4,856,205 | 8/1989 | Meyer et al. | 34/117 |
| 4,881,327 | 11/1989 | Hauser et al. | 34/117 |
| 4,934,067 | 6/1990 | Wedel | 34/114 |
| 5,050,317 | 9/1991 | Kade et al. | 34/117 |
| 5,065,529 | 11/1991 | Skaugen et al, | 34/117 |
| 5,101,577 | 4/1992 | Wedel | 34/114 |
| 5,105,561 | 4/1992 | Wulz | 34/117 |

FOREIGN PATENT DOCUMENTS 8806205 8/1988 World Int. Prop. O. .

8808898 11/1988 World Int. Prop. O. .

*Primary Examiner*—Denise L. Gromada

*Attorney, Agent, or Firm*—Ostrolenk, Faber, Gerb & Soffen

[57] ABSTRACT

An arrangement for transferring a paper web from the last drying cylinder of a first dryer group to the first dryer cylinder of a second dryer group. The last of the first drying cylinders lies outside a first endless loop porous support belt of the first dryer group. The first of the second drying cylinders lies outside a second endless loop porous support belt of the second dryer group. A first guide roll lies inside the loop of the first belt and is spaced from the first cylinder. A second guide roll lies inside the loop of the second belt, and is spaced from the second drying cylinder and along the path of the first belt between the first drying cylinder and the first guide roll. The second belt wraps around the second guide roll and the web on the first belt contacts the second belt on the path of the first belt toward the first guide roll. An air guide box upstream of the first guide roll directs air against the first belt into a wedge-shaped zone upstream in the travel path of the first belt for helping to transfer the web from the first belt to the second belt. The air guide box may have a stripper to strip air off the first belt, a wall that diverges from the first belt in the path toward the first guide roll, and a deflection surface for deflecting air passing along the first belt at the first guide roll.

20 Claims, 3 Drawing Sheets

16a
6'
6
7
16b
11
9
16c
16
11
17
U
14
I
II
a
13
16'
Z
d
18'
12
18
8
12

ARRANGEMENT FOR THE TRANSFER OF A TRAVELING WEB

BACKGROUND OF THE INVENTION

The present invention relates to an arrangement for transferring a traveling web, preferably a paper web which is to be dried, from a first drying cylinder at a first porous support belt to a second drying cylinder at a second porous support belt between the two cylinders. Such an arrangement is used, for example, in paper manufacturing machines, particularly in the dry end. The arrangement is used for transferring the web of paper being produced from the support belt of one dryer group, which customarily comprises a plurality of heatable drying cylinders, to the support belt of a subsequent dryer group, which also comprises a plurality of heatable drying cylinders. The arrangement can, however, also be used within a so called twin wire dryer group for the repeated transfer of the web to be dried from the upper dryer wire to the lower dryer wire, and vice versa.

Known transfer arrangements for this type are described in the following publications: 1) Federal Republic of Germany Utility Model 89 06 273, which is equivalent to U.S. Pat. No. 5,050,317; 2) Federal Republic of Germany Utility Model 90 01 209, which is equivalent to U.S. application Ser. No. 07/467,788; 3) U.S. Pat. No. 3,868,780 at FIG. 8; 4) U.S. Pat. No. 3,250,019; and 5) U.S. Pat. No. 5,101,577.

In accordance with Reference 1) or 2) the second guide roll along the path between the two cylinders lies within the loop of the first endless support belt and is developed as a suction roll or a vacuum roll and is also known as a "pick-up roll". As is known, the shell of the guide roll is perforated and a vacuum must be produced within the roll, preferably by means of a stationary suction box which defines a specific partially circumferential or angular suction zone. Suction rolls of this kind have high manufacturing costs and operating expenses. Therefore the arrangements according to References 3, 4 and 5 attempt to get along using ordinary guide rolls, i.e. rolls which are free of suction means. However, arrangements using ordinary guide rolls at the transfer between dryer groups do not always operate dependably, particularly at extremely high operating speeds now desired, which may be between 500 and 2000 m/min.

A certain improvement can be obtained according to FIG. 9 of Reference 5 because the travel paths of the two support belts form a small angle of divergence with each other upon departure from the second guide roll. This differs from the parallel guidance in References 3 and 4. However, diverging belt paths present a problem too. On one hand, the place at which the first support belt travels onto the first guide roll should be located at a sufficiently large distance from the web which is traveling together with the second support belt. This should avoid the web being lifted off again from the second support belt within this region by the rotation of the first guide roll, which causes a vacuum. This danger is present if the angle of divergence is selected to be too small or even if it assumes a value of 0, i.e. parallel guidance. On the other hand, it is not desired to make the angle of divergence too great, in order that the web may experience the smallest possible deflection at its place of transfer.

SUMMARY OF THE INVENTION

It is an object of the present invention to improve the arrangement described above so that it operates dependably without suction means even at the high operating speeds mentioned, while the web is deflected as little as possible along the path of transfer between dryer groups.

This object is achieved by the invention which is an arrangement for transferring a paper web from the last drying cylinder of a first single tier dryer group to the first drying cylinder of a Second single tier dryer group. The last of the first drying cylinders lies outside the first endless loop porous support belt of the first dryer group. The first or initial one of the second dryer cylinders lies outside the second endless loop porous support belt of the second dryer group. A first guide roll lies inside the first endless loop of the first belt and is spaced from the first cylinder. A second guide roll lies inside the second endless loop of the second belt, is spaced from the second drying cylinder and is also spaced along the path of the first belt between the first drying cylinder and the first guide roll. The second belt wraps around the second guide roll. Then the web on the first belt contacts the second belt on the path of the first belt to the first guide roll.

An air guide box upstream of the first guide roll and on the side of the first belt that is inside the first loop directs air into the wedge shaped zone that is upstream in the path of the first belt toward the first guide roll for helping to transfer the web off the first belt to the second belt by blowing the air through the first belt. The air guide box may have a first stripper at the first drying cylinder to strip air off the support belt there. The air guide box may have a wall that diverges from the first belt in the path toward the first guide roll, and may have an air deflection surface for deflecting air passing along the first belt against the web, generally at the first guide roll.

With the invention, the web can travel on a substantially straight travel path directly from the last of the first drying cylinders to the place of transfer and from there directly to the first of the second drying cylinders. As compared with the arrangement in accordance with either of Reference 1 or 2, two suction rolls previously at the transfer can be replaced with ordinary guide rolls. A saving is thus obtained, in addition to greater reliability in operation, since one or two deflections of the web are done away with and since the web is reliably transferred by a stream of air from the first support belt to the second support belt. A stream of air is conducted through the first support belt by an air guide box located shortly upstream of where the first support belt contacts the first guide roll. As a result of its rotation, the first guide roll itself also produces a stream of air downstream of the contact of the web with the first guide roll, which stream is forced through the first support belt. However, a satisfactory result is obtained only if an additional stream of air, which combines with the stream of air produced by the guide roll, is produced by the air guide box. This eliminates the danger of the web being again lifted off the second support belt by the first guide roll as the result of a relatively small angle of divergence.

The arrangement of the invention assures a very reliable transfer of the web even at very high operating speeds and even if the angle of support belt divergence is very small, or in the extreme case, equal to zero. The additional stream of air can be produced by means of blast openings and/or by deflection of the air boundary layer which arrives with the first support belt.

Other objects, features and advantages of the present invention will become apparent from the following description of the invention which refers to the accompanying drawings.

DESCRIPTION OF THE PREFERRED EMBODIMENTS

Figure 1:
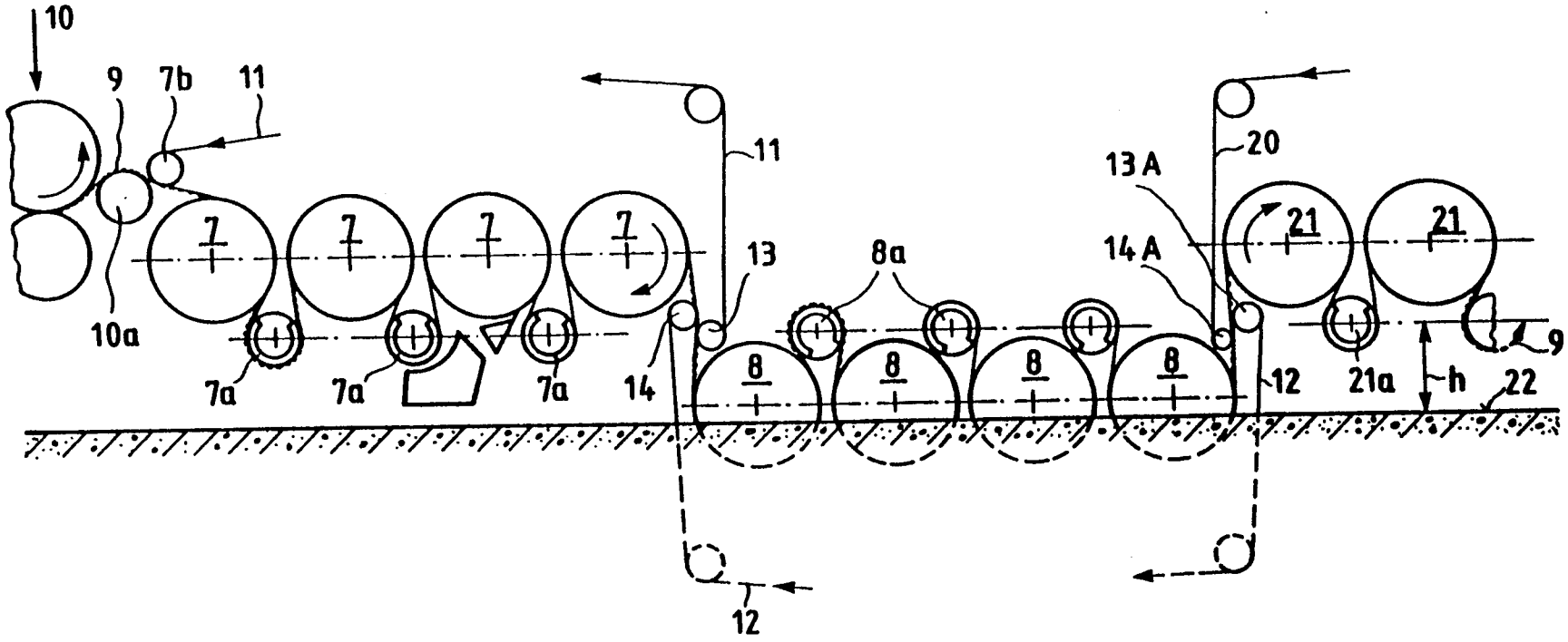
FIG. 1 is a diagrammatic partial view of a dry end of a paper making machine having a plurality of single tier dryer groups arranged one after the other and including the invention.

The dry end shown in FIG. 1 is part of a paper manufacturing machine. The paper web 9 which is to be dried is shown in part as a dotted line. The web travels through the dry end from left to right, as seen in FIG. 1.

A first dryer group comprises four upper heatable drying cylinders 7 and three lower suction rolls 7*a* which serve as reversal rolls, and each roll is between two of the dryer cylinders. The web 9 comes from a press section 10 of the paper manufacturing machine and is transferred by means of a paper guide roll 10*a* to a first endless porous support belt 11, which is preferably developed as a drying wire. The support belt 11 first travels over a guide roll 7*b* which, if necessary, can also be developed as a suction roll. The paper web 9, together with the support belt 11, then travels along a meander pathway through the first dryer group, i.e. alternately over one of the drying cylinders 7 and then over the neighboring reversing roll 7*a*. In this connection, the bottom side of the paper web 9 comes into contact with the drying cylinders.

A second dryer group comprises four bottom drying cylinders 8 and three upper reversing rolls or suction rolls 8*a* with a respective suction roll 8*a* between each two drying cylinders 8. A second endless porous support belt 12 travels through this dryer group and presses the paper web against the lower region of each drying cylinder 8 so that the top side of the paper web 9 comes into contact with the drying cylinders 8. The second group is followed by a third dryer group with a support belt 20 and drying cylinders 21 with which the bottom side of the paper web 9 again comes into contact.

In the drawings, and particularly as seen in FIG. 1, the first cylinders 7 are in one row and the second cylinders 8 are in another row. The reversing rolls 7*a* are below the rolls 7, but need just be low enough to cause the belt 11 and the web to wrap the tops of the cylinders 7. The second cylinders 8 and the respective reversing rolls 8*a* are inverted in their positions relative to cylinders 7 and rolls 7*a* to cause the web to wrap the bottoms of the cylinders 8.

For the transfer of the paper web 9 from the first dryer group containing the first drying cylinders 7 to the second dryer group containing the second drying cylinders 8 there is a substantially linear path of travel of the first and second support belts 11 and 12 which is predominantly vertical or which may be slightly inclined to the vertical. Within this travel path, the support belts overlap each other along the part of their paths from the guide roll 14 to the guide roll 13 and the web of paper 9 is transferred from the one support belt to the other at that overlapping region.

Figure 2:
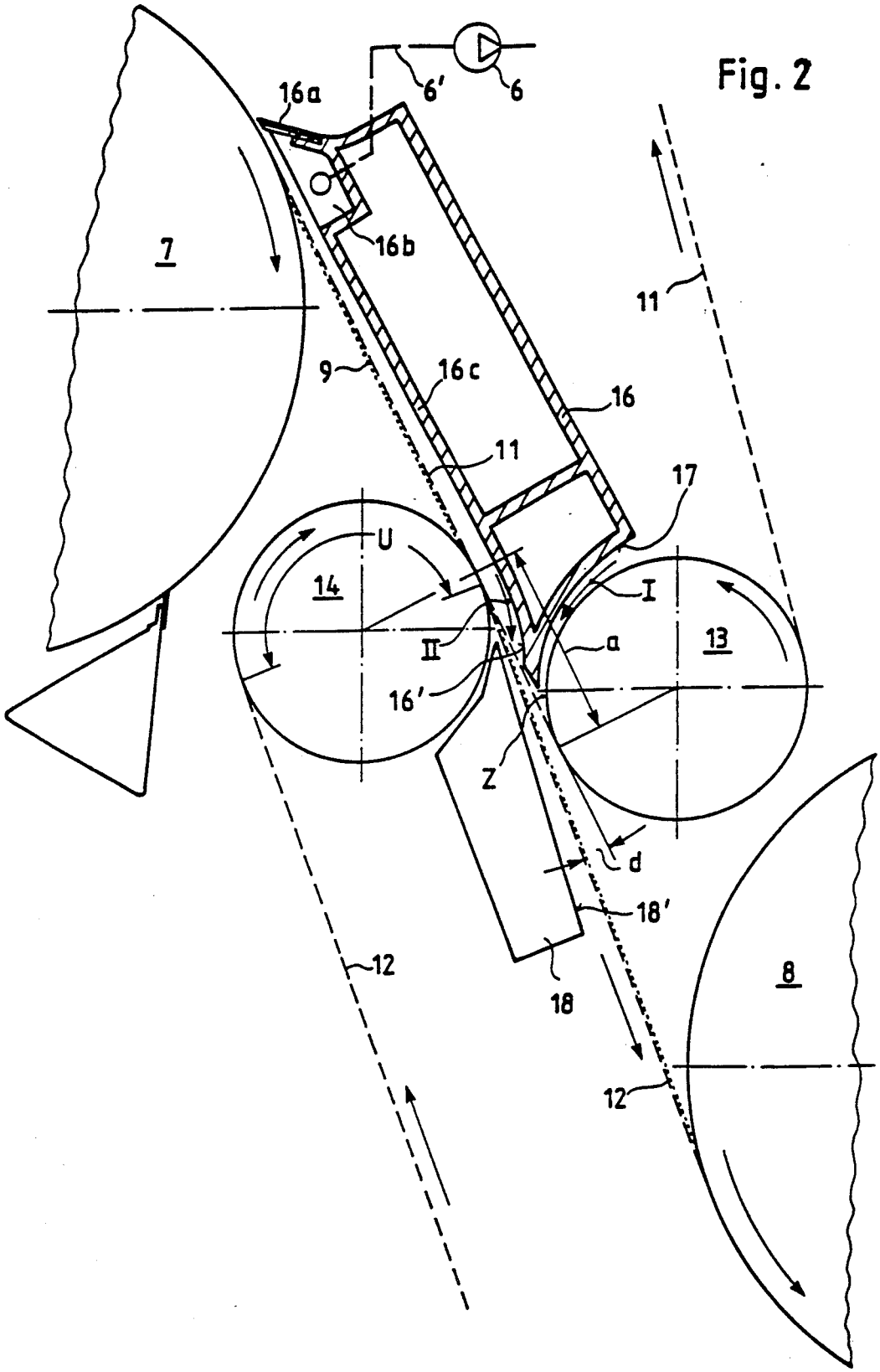
FIG. 2 is an enlarged showing, as compared with FIG. 1, of a place of separation between two dryer groups.
Figure 3:
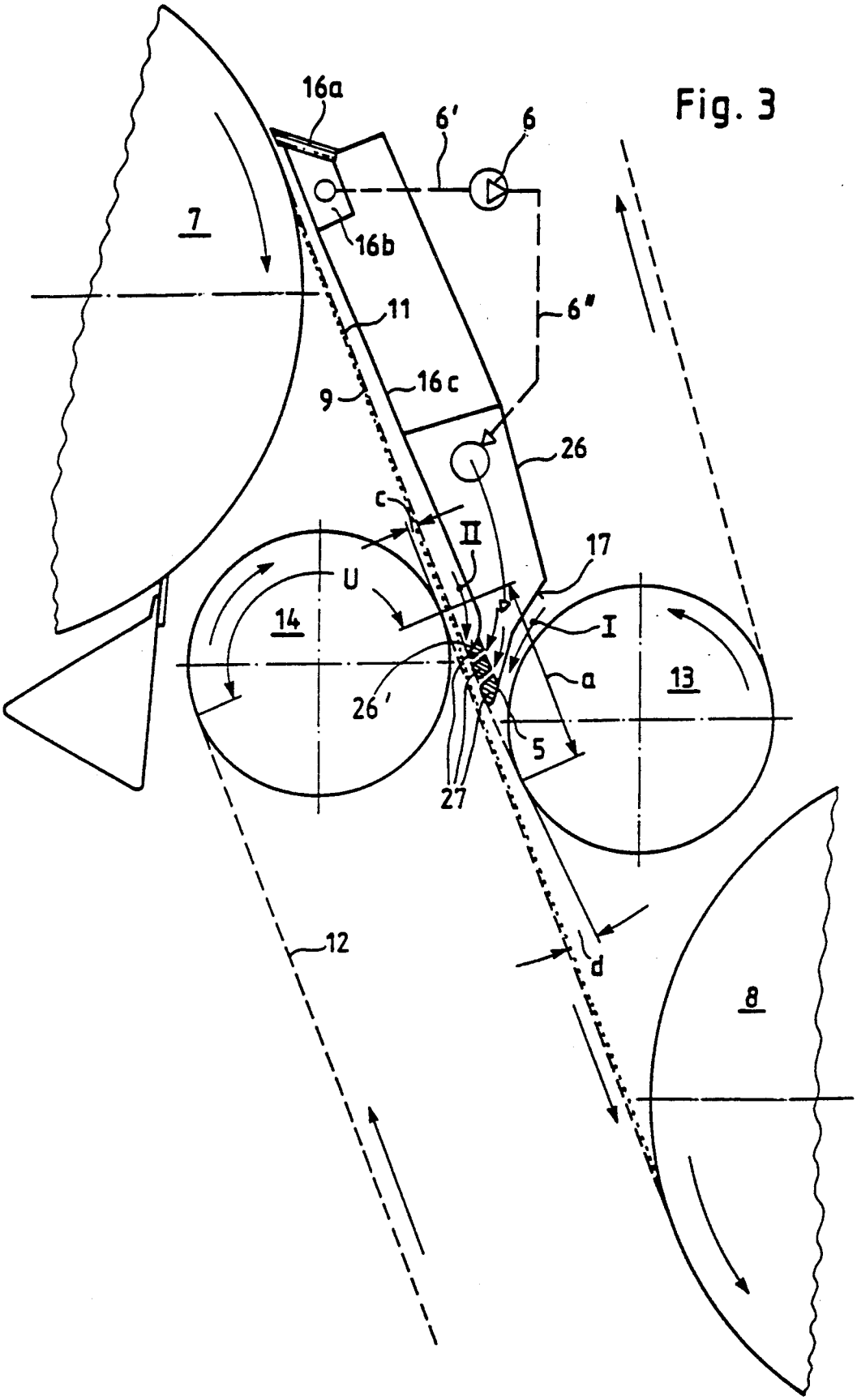
FIG. 3 shows such a place of separation which is slightly modified as compared with FIG. 2.

Details of the arrangement for the transfer of the web 9 from a first drying cylinder 7, for instance, the last drying cylinder of the first dryer group, to a second drying cylinder 8, for instance, the first or initial drying cylinder of the second dryer group, can be noted from FIG. 2. The first web support belt 11 travels from above on at least a predominantly straight travel path from the drying cylinder 7 to a first guide roll 13 and from that roll upward and back to the belt guide roll 7*b*. The second support belt 12 travels from below to a second guide roll 14 above the first guide roll, wraps the guide roll in a wrapping zone U and travels from the roll 14 directly onto the second drying cylinder 8. As shown in FIG. 2, the travel path of the first support belt from the drying cylinder 7 to the first guide roll 13 is linear and simultaneously is tangent to the wrapping zone U of the second guide roll 14. To alter this, the following result can be obtained by horizontal displacement of one of the two guide rolls 13 or 14. Either the first support belt 11 wraps slightly around the second guide roll 14 or, as shown in FIG. 3, a small distance c is provided between the first support belt 11 and the second guide roll 14.

The path of travel of the first support belt 11 to the first guide roll 13 and the path of travel of the second support belt 12 coming off the second guide roll 14 move in the same direction and form an angle of divergence d with each other, which angle should be made as small as possible. The transfer of the paper web 9 from the first support belt 11 to the second support belt 12 is effected with the assistance of the counterclockwise rotating guide roll 13. The high circumferential speed of the guide roll 13, which is on the order of between 500 and 2000 m/min, produces a stream of air shown by arrow I, and produces excess pressure in the wedge-shaped space Z, wherein the first support belt 11 travels onto the first guide roll 13. This forces a stream of air through the first porous support belt 11 into the wedge shaped space which is present between the two support belts 11 and 12 and which has the angle of divergence d.

In order to increase the air transfer effect, an air guide box 16 is arranged within the endless loop of the first support belt 11 between the first cylinder 7 and the first guide roll 13. This box 16 has a wall 17 whose shape is adapted to the shell of the guide roll 13 and extends down into the wedge Z and guides the stream of air (arrow I). Furthermore, the air guide box 16 is provided on its side facing the support belt 11, and shortly in front or upstream of the place where the support belt 11 runs onto the first guide roll 13, with a deflection surface 16' which also guides the air boundary layer arriving with the first support belt 11, arrow II, through the support belt. The additional flow of air which is thus produced penetrates through the first support belt 11, detaches the paper web 9 from the first support belt 11 and presses it toward and then against the second support belt 12.

Furthermore, a web stabilizer 18 may be arranged in the wedge-shaped space between the second guide roll 14 and the departing second support belt 12. The guide surface 18' of the stabilizer diverges in a known manner from the second support belt 12. The transfer of the web 9, i.e. the detachment of the web from the first support belt 11, is also supported by the vacuum formed between the surface of the guide roll 14 and the second support belt 12 travelling off that guide roll.

The air guide box 16 preferably also functions as a further web stabilizer, between the place of departure of the first support belt 11 from the first cylinder 7 up to the second guide roll 14. For this purpose, the air guide box has the following known parts. A ledge 16*a*, which has the function of a boundary air layer stripper, extends at a slight distance from the wall of the cylinder 7 and transversely over the first support belt 11. The ledge 16*a* at the same time defines a suction zone 16*b* arranged in the region of the place where the support belt 11 moves off the cylinder 7. Vacuum is produced in the suction zone 16*b* by a suction line 6' and suction blower 6.

Adjoining the zone 16*b*, the air guide box 16 has a guide surface 16*c*, which diverges from the first support belt 11. The guide surface 16*c* directly adjoins the guide surface. Between the support belt 11 and the guide surface 16*c*, a vacuum is formed so that the paper web 9 is maintained in dependable contact with the support belt 11. A new boundary air layer is formed in the space present between the support belt 11 and the guide surface 16*c*. That air layer is transported by the support belt 11 up to the deflection surface 16' and, with the aid of the surface 16', as already mentioned, the air layer is forced through the support belt 11.

The distance a from the place where the first support belt 11 passes the wrapping zone U of the second guide roll 14 up to the place where it runs onto the first guide roll 13 depends on various factors. It should be ascertained by experiment. The controlling factor is the air permeability in particular of the first support belt 11 and possibly also the basis weight of the web of paper to be produced.

In the modified embodiment of FIG. 3, an air guide box developed as a blast box 26 is arranged within the loop of the first support belt 11. That box has, for instance, two or three slide ledges 27 which are opposite the place where the second support belt 12 moves off the second guide roll 14. It has a blast slot 5 or two blast slots between each two of the ledges. The first support belt 11 slides over the slide ledges 27 and is slightly deflected around them. Between the two support belts 11 and 12, an angle of divergence d may again be present, as shown in FIG. 3. Due to the deflection of the support belt 11 on the slide ledges 27, it is, however, also possible that the two support belts 11, 12 travel parallel to each other up to the guide roll 13. Such an air guide box 26, which contributes essentially to the dependable transfer of the web 9 from the first support belt to the second support belt, is preferably employed when, as shown in FIG. 3, a small distance c is present between the first support belt 11 and the wrapping zone of the second guide roll 14. A similar air guide box with blast slots can also be provided in the arrangement in accordance with FIG. 2.

In FIG. 3, the air guide box 26, as in FIG. 2, has an air boundary layer stripper 16*a*, a suction zone 16*b*, and a guide surface 16*c* which diverges from the first support belt 11. This guide surface, in its turn, merges directly into a deflection surface 26' which is formed in part by the first of the ledges 27. The blower 6, which produces vacuum in the suction zone 16*b*, is also connected to the blast slots 5 by a pressure line 6''.

The explanations given in connection with FIGS. 2 and 3 apply also to the transfer of the web in FIG. 1 from the second support belt 12 of the second dryer group to the third support belt 20 of the third dryer group. In that transfer, the first guide roll is designated 13A and the second guide roll 14A. It may again be emphasized that none of the guide rolls 13, 14, 13A, 14A at the web transfers between dryer groups need be developed as suction rolls. Another advantage is that all of the reversal rolls 7*a*, 8*a*, 21*a*, which are developed as a suction roll, can be arranged at the same height h above the foundation 22. This permits the use of a large number of identical frame parts.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An arrangement for transferring a traveling web to be dried from a first drying cylinder to a second drying cylinder, the arrangement comprising:

a first porous support belt for traveling together with the web, the first belt having a first side for supporting the web and the first side of the first belt first wrapping the web around the first cylinder and then passing with the web away from the first cylinder;

a first guide roll spaced away from the first cylinder, the first guide roll being free of suction devices;

the first belt having a second side opposite the first side thereof, the second side of the first belt wrapping around the first guide roll after the web has been separated from the first belt;

a second porous support belt for traveling with the web, the second support belt having a third side for receiving the web from the first support belt and for supporting the web and having an opposite fourth side;

a second guide roll over which the fourth side of the second support belt wraps, thereby forming a wrapping zone along the second guide roll; the second guide roll being free of suction devices; the second drying cylinder being placed with respect to the first and second guide rolls such that the web is transferred from the first side of the first support belt to the third side of the second support belt and the web then passes on the third side of the second support belt and is wrapped directly around the second drying cylinder;

the first cylinder and the first guide roll defining a travel path for the first support belt therebetween; the second guide roll being placed near the travel path of the first support belt from the first drying cylinder to the first guide roll; the travel path of the first support belt in the direction toward the first guide roll passing said wrapping zone and that passing is located at a first distance upstream in the path of the first support belt from where the first support belt meets the first guide roll to wrap therearound;

air guide means located above the second side of the first support belt, along the travel path of the first support belt, and at the first guide roll upstream in the travel path of the first support belt where the first support belt contacts the first guide roll, said air guide means being provided for directing air through the first porous support belt to separate the web from the first support belt and bring the separated web into supporting contact with the second support belt, such that the second support belt receives the web and thereafter supports the web to move the web toward the second cylinder.

2. The arrangement of claim 1, further comprising first guide means for guiding the first support belt in a first loop and second guide means for guiding the second support belt in a second loop, wherein the first support belt is an endless loop having an outside and an inside; the first drying cylinder being located outside the loop of the first support belt, the first guide roll being located inside the loop of the first support belt; the first side of the first support belt, which supports the web, forming the outside of the first loop;

the second support belt being an endless loop having an outside and an inside; the second drying cylinder being located outside the loop of the second support belt, the second guide roll being located inside the loop of the second support belt; the third side of the second support belt, which is the side thereof to which the web is transferred, forms the outside of the second loop;

the second guide means supporting the second support belt so as to define the wrap zone of the second support belt around the second guide roll.

3. The arrangement of claim 2, further comprising a first dryer group having a first plurality of the first drying cylinders alternating with a respective first reversal roll between each two first cylinders, the first guide means guiding the first support belt along a meander path alternately passing one of the first cylinders and then one of the first reversal rolls, and the outside of the endless loop of the first support belt forming the first side of the first support belt supporting the web in the meander path, each first drying cylinder being located on the outside of the first loop such that the web supported on the first side of the first support belt contacts the first drying cylinders and the inside of the first loop contacts the first reversal rolls; the first drying cylinder being a final drying cylinder in the first dryer group;

a second dryer group having a second plurality of second drying cylinders alternating with a respective second reversal roll disposed between each two second cylinders, the second guide means guiding the second support belt along a meander path alternately passing one of the second drying cylinders and then one of the second reversal rolls and the outside of the second loop forming the third side for supporting the web, each second drying cylinder being located on the outside of the second loop, such that the web supported on the third side of the second support belt contacts the second drying cylinders and the fourth side of the second support belt forming the inside of the second loop which contacts the second reversal rolls; a first second drying cylinder being an initial drying cylinder of the second dryer group.

4. The arrangement of claim 3, wherein in one of the first and second dryer groups, the reversal rolls are disposed somewhat below the drying cylinders while in the other of the first and second dryer groups, the reversal rolls are somewhat disposed above the drying cylinders, and the first and second support belts supporting the web so that one side of the web is dried by the drying cylinders in one of the first and second dryer groups and the other side of the web is dried by the drying cylinders in the other dryer group.

5. An arrangement for transferring a traveling web to be dried from a first drying cylinder to a second drying cylinder, the arrangement comprising:

a first porous support belt for traveling together with the web, the first belt having a first side for supporting the web and the first side of the first belt first wrapping the web around the first cylinder and then passing with the web away from the first cylinder;

a first guide roll spaced away from the first cylinder, the first guide roll being free of suction devices;

the first belt having a second side opposite the first side thereof, the second side of the first belt wrapping around the first guide roll after the web has been separated from the first belt;

a second porous support belt for traveling with the web, the second support belt having a third side for receiving the web from the first support belt and for supporting the web and having an opposite fourth side;

a second guide roll over which the fourth side of the second support belt wraps, thereby forming a wrapping zone along the second guide roll; the second guide roll being free of suction devices; the second drying cylinder being placed with respect to the first and second guide rolls such that the web is transferred from the first side of the first support belt to the third side of the second support belt and the web then passes on the third side of the second support belt and is wrapped directly around the second drying cylinder;

the first cylinder and the first guide roll defining a travel path for the first support belt therebetween; the second guide roll being placed near the travel path of the first support belt from the first drying cylinder to the first guide roll; the travel path of the first support belt in the direction toward the first guide roll passing said wrapping zone and that passing is located at a first distance upstream in the path of the first support belt from where the first support belt meets the first guide roll to wrap therearound;

air guide means located above the second side of the first support belt, along the travel path of the first support belt, and at the first guide roll upstream in the travel path of the first support belt where the first support belt contacts the first guide roll, said air guide means being provided for directing air through the first porous support belt to separate the web from the first support belt and bring the separated web into supporting contact with the second support belt, such that the second support belt receives the web and thereafter supports the web to move the web toward the second cylinder; and an air deflection surface formed on the air guide means and generally at a location past the second guide roll in the travel path of the first support belt toward the first guide roll, the air deflection surface being directed to deflect a layer of boundary air, which arrives with the second side of the first support belt, through the porous first support belt to help separate the web from the first side of the first support belt and to help transfer the web to the third side of the second support belt.

6. The arrangement of claim 5, further comprising blast openings defined in the air guide means for directing an air blast from the air guide means toward the second side of the first support belt in the region of the travel path of the first support belt after the first support belt contacts the second guide roll and before the first support belt contacts the first guide roll.

7. The arrangement of claim 5, wherein the air guide means comprises an air guide box which extends upstream from the deflection surface along the first support belt, opposite the direction of travel of the first support belt, to a place of departure where the first support belt moves off the first cylinder along the travel path of the first support belt toward the first guide roll;

the air guide box having a boundary air layer stripper located in the region of the place of departure of the first support belt from the first dryer cylinder for stripping the boundary air layer off the second side of the first support belt as it is moving past the air guide box.

8. The arrangement of claim 7, wherein the air guide box includes a guide surface extending along the path of travel of the first support belt from the first dryer cylinder to the air deflection surface of the air guide box, the guide surface being oriented to diverge from the first support belt in the direction of travel of the first support belt toward the deflection surface of the air guide box.

9. The arrangement of claim 8, wherein the air guide box includes a suction zone at the second side of the first support belt and in the region of the departure of the first support belt from the first cylinder and after the boundary air layer stripper.

10. The arrangement of claim 5, further comprising a boundary air layer stripper at the second side of the first support belt and located in the region of the place around the first dryer cylinder where the first support belt departs from the first cylinder for stripping the boundary air layer off the second side of the first support belt as it is moving past the air guide means.

11. The arrangement of claim 8, wherein the first dryer cylinder and the first guide roll are respectively so placed and the second guide roll and the second dryer cylinder are respectively so placed that the path of travel of the first support belt to the first guide roll which path is past the second guide roll, has a small angle of divergence with respect to the path of travel of the second support belt off the second guide roll toward the second cylinder.

12. The arrangement of claim 11, where the small angle of divergence of the paths of the first and second support belts is at least 1°.

13. The arrangement of claim 8, further comprising a wall on the air guide box which is generally adapted to the shape of the first guide roll and is wrapped partly around the first guide roll, the air guide box wall extends into a wedge-shaped space where the first support belt is traveling toward and meets with the first guide roll, the wall being for directing air into the wedge-shaped space.

14. The arrangement of claim 7, further comprising a wall on the air guide box which is generally adapted to the shape of the first guide roll, is wrapped partly around the first guide roll and the air guide box wall extends into a wedge-shaped space where the first support belt is traveling toward and into contact with the first guide roll, the wall being for directing air into the wedge-shaped space.

15. The arrangement of claim 5, further comprising a wall on the air guide means which is generally adapted to the shape of the first guide roll and is wrapped partly around the first guide roll, the air guide means wall extends into a wedge-shaped space where the first support belt is traveling toward and into contact with the first guide roll, the wall being for directing air into the wedge-shaped space.

16. The arrangement of claim 15, further comprising a web stabilizer at the fourth side of the second support belt and following the second guide roll in the travel path of the second support belt toward the second cylinder, the web stabilizer having a surface that faces toward the second support belt and that diverges away from the second support belt along the travel path of the second support belt away from the second guide roll.

17. An arrangement for transferring a traveling web to be dried from a first drying cylinder to a second drying cylinder, the arrangement comprising:

a first porous support belt for traveling together with the web, the first belt having a first side for supporting the web and the first side of the first belt first wrapping the web around the first cylinder and then passing with the web away from the first cylinder;

a first guide roll spaced away from the first cylinder, the first guide roll being free of suction devices;

the first belt having a second side opposite the first side thereof, the second side of the first belt wrapping around the first guide roll after the web has been separated from the first belt;

a second porous support belt for traveling with the web, the second support belt having a third side for receiving the web from the first support belt and for supporting the web and having an opposite fourth side;

a second guide roll over which the fourth side of the second support belt wraps, thereby forming a wrapping zone along the second guide roll; the second guide roll being free of suction devices; the second drying cylinder being placed with respect to the first and second guide rolls such that the web is transferred from the first side of the first support belt to the third side of the second support belt and the web then passes on the third side of the second support belt and is wrapped directly around the second drying cylinder;

the first cylinder and the first guide roll defining a travel path for the first support belt therebetween; the second guide roll being placed near the travel path of the first support belt from the first drying cylinder to the first guide roll; the travel path of the first support belt in the direction toward the first guide roll passing said wrapping zone and that passing is located at a first distance upstream in the path of the first support belt from where the first support belt meets the first guide roll to wrap therearound;

air guide means located above the second side of the first support belt, along the travel path of the first support belt, and at the first guide roll upstream in the travel path of the first support belt where the first support belt contacts the first guide roll, said air guide means being shaped and adapted to direct air through the first porous support belt to separate the web from the first support belt and bring the separated web into supporting contact with the second support belt, such that the second support belt receives the web and thereafter supports the web to move the web toward the second cylinder; and air deflection means formed on the air guide means and generally at a location past the second guide roll in the travel path of the first support belt toward the first guide roll, the air deflection surface directing air through the porous first support belt to help separate the web from the first side of the first support belt and to help transfer the web to the third side of the second support belt.

18. The arrangement of claim 17, wherein the first dryer cylinder and the first guide roll are respectively so placed and the second guide roll and the second dryer cylinder are respectively so placed that the path of travel of the first support belt to the first guide roll, which path is past the second guide roll, has a small angle of divergence with respect to the path of travel of the second support belt off the second support guide roll toward the second cylinder.

19. The arrangement of claim 1, wherein the first dryer cylinder and the first guide roll are respectively so placed and the second guide roll and the second dryer cylinder are respectively so placed that the path of travel of the first belt to the first support guide roll, which path is past the second guide roll, has a small angle of divergence with respect to the path of travel of the second belt off the second support guide roll toward the second cylinder.

20. An arrangement for transferring a traveling web to be dried from a first drying cylinder to a second drying cylinder, the arrangement comprising:

a first porous support belt for traveling together with the web, the first belt having a first side for supporting the web and the first side of the first belt first wrapping the web around the first cylinder and then passing with the web away from the first cylinder;

a first guide roll spaced away from the first cylinder, the first guide roll being free of suction devices;

the first belt having a second side opposite the first side thereof, the second side of the first belt wrapping around the first guide roll after the web has been separated from the first belt;

a second porous support belt for traveling with the web, the second support belt having a third side for receiving the web from the first support belt and for supporting the web and having an opposite fourth side;

a second guide roll over which the fourth side of the second support belt wraps, thereby forming a wrapping zone along the second guide roll; the second guide roll being free of suction devices; the second drying cylinder being placed with respect to the first and second guide rolls such that the web is transferred from the first side of the first support belt to the third side of the second support belt and the web then passes on the third side of the second support belt and is wrapped directly around the second drying cylinder;

the first cylinder and the first guide roll defining a travel path for the first support belt therebetween; the second guide roll being placed near the travel path of the first support belt from the first drying cylinder to the first guide roll; the travel path of the first support belt in the direction toward the first guide roll passing said wrapping zone and that passing is located at a first distance upstream in the path of the first support belt from where the first support belt meets the first guide roll to wrap therearound;

air guide means located above the second side of the first support belt, along the travel path of the first support belt, and at the first guide roll upstream in the travel path of the first support belt where the first support belt contacts the first guide roll, said air guide means being provided for directing air through the first porous support belt to separate the web from the first support belt and bring the separated web into supporting contact with the second support belt, such that the second support belt receives the web and thereafter supports the web to move the web toward the second cylinder; and blast openings defined in the air guide means for directing an air blast from the air guide means toward the second side of the first support belt in the region of the path of the first support belt after the first support belt contacts the second guide roll and before the first support belt contacts the first guide roll.

* * * * *